US006217734B1

(12) United States Patent
Uzoh

(10) Patent No.: US 6,217,734 B1
(45) Date of Patent: Apr. 17, 2001

(54) ELECTROPLATING ELECTRICAL CONTACTS

(75) Inventor: Cyprian E. Uzoh, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/255,996

(22) Filed: Feb. 23, 1999

(51) Int. Cl.[7] ..... C25D 5/02

(52) U.S. Cl. ..... 205/118; 204/224 R; 204/289; 204/290 R; 204/297 M

(58) Field of Search ..... 204/224 R, 289, 204/297 R, 297 M, 290 R; 205/118

(56) References Cited

U.S. PATENT DOCUMENTS 4,464,242 * 8/1984 Boulton ..... 204/253
5,429,733 7/1995 Ishida ..... 204/224 R
5,620,581 4/1997 Ang ..... 205/96
5,660,699 * 8/1997 Saito et al. ..... 204/297
5,807,165 * 9/1998 Uzoh et al. ..... 451/41
6,037,790 * 3/2000 Dinan ..... 324/757

* cited by examiner

*Primary Examiner*—Kathryn Gorgos
*Assistant Examiner*—Thomas H. Parsons
(74) *Attorney, Agent, or Firm*—Pollock, Vande Sande & Amernick, R.L.L.P.; Joseph P. Abate, Esq.

(57) ABSTRACT

An electrodeposition apparatus for depositing material on a surface of a substrate. The electrodeposition apparatus includes at least one contact for laterally contacting the substrate and providing electrical connection to the substrate. The at least one contact does not obscure the surface of the substrate to be plated. A voltage source is connected to the at least one contact.

87 Claims, 5 Drawing Sheets

ELECTROPLATING ELECTRICAL CONTACTS

BACKGROUND OF THE INVENTION

1. Field of the Invention

The invention relates to a method and apparatus for electrodepositing on a substrate. In particular, the present invention relates to a method and apparatus for electrodeposition, electroetching, and/or electropolishing in semiconductor device manufacturing.

2. Description of the Related Art

In the production of microelectronic devices, metal may be plated on a semiconductor for a variety of purposes. The metal may be deposited to form vias or conductive lines, such as wiring structures. Typically, metal is plated on the substrates and cells of reservoirs that hold a plating solution that includes at least one metal and/or alloy to be plated on the substrate.

Plating baths are commonly used in microelectronic device manufacture to plate at least one material, such as a metal on a substrate for a wide variety of applications. For example, plating baths may be utilized for electroplating and/or electroless plating on substrates of one or more metals and/or alloys.

SUMMARY OF THE INVENTION

The present invention provides an apparatus for depositing material, electroetching, and/or electropolishing on a surface of a substrate. The apparatus includes at least one contact for laterally contacting the substrate and providing an electrical connection to the substrate. The at least one contact does not obscure the surface of the substrate to be plated. A voltage source is connected to the at least one contact.

The present invention also includes a method for depositing material on a surface of a substrate. The method includes laterally engaging a substrate on which a material is to be deposited with at least one contact for laterally contacting the substrate and providing electrical connection to the substrate without obscuring the surface of the substrate to be plated. A voltage source is connected to the at least one contact.

Still other objects and advantages of the present invention will become readily apparent to those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

Electrodeposition methods have been developed as a technique to deposit metal(s) and alloy(s) on surfaces of semiconductor substrates. Typically, for electrodeposition methods to function, reliable and practical electrical contact must be made to a substrate. Often, to help prevent deposition on side surfaces of a substrate, a region in the vicinity of the edge of the substrate is not plated.

Preventing plating of a region in the vicinity of the edge of the substrate may be accomplished by not placing a seed layer in the vicinity of the edge of the substrate. Alternatively, a structure may be placed over the edge of the substrate to prevent deposition of metals in the vicinity. Where edge exclusion is carried out, typically, about 2 to about 5 mm of the edge may be excluded. Typically, the primary penalty for not plating or not being able to plate in the vicinity of the edge of a semiconductor substrate is a decrease in the chip yield from a wafer and a loss of flexibility of chip layout.

According to one example, that of chip interconnection wiring applications, a seed layer may be deposited on a structure prior to electrodeposition. For example, in the case of copper interconnection wiring structures, a thin copper seed layer may be deposited on the substrate. The seed layer may not be deposited in the vicinity of the edge of the substrate to avoid the side surface plating problem. However, to make reliable contact to a substrate to help ensure uniform plating, electrical contact typically is made about 3 mm into the seed layer. When the electrical contacts are sealed, either in a continuous or discontinuous manner, the excluded fraction of the wafer increases further.

To solve the above and other problems, the present invention provides a new method and structure for making electrical contact with semiconductor substrates. For example, the present invention helps to eliminate the need for edge exclusion from plating or for electrical contact to be made on the surface of the wafer or away from the edge of the wafer by as much as 5 mm. As a result, the present invention permits the entire surface of the semiconductor substrate to be plated. Furthermore, the present invention can improve chip yields and chip counts on wafers as well as increase flexibility of chip layout.

Figure 1:
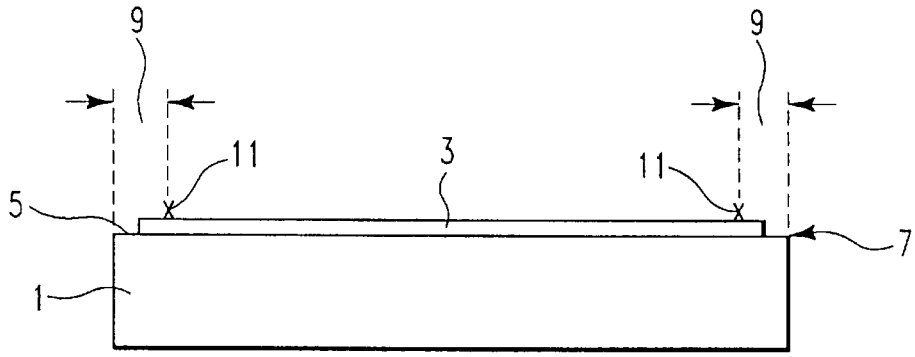
FIG. 1 PRIOR ART
FIG. 1 represents a cross-sectional view of a typical semiconductor substrate showing regions normally plated in known electrodeposition apparatuses.

FIG. 1 illustrates typical arrangement of a semiconductor substrate and a plating apparatus. Accordingly, FIG. 1 illustrates a semiconductor substrate 1, such as a wafer. A seed layer 3 is formed on the upper surface 5 of the substrate 1. As FIG. 1 illustrates, the seed layer does not extend all the way to the edge 7 of the substrate 1. Rather, an exclusion zone 9 about 1 to about 5 mm is not plated. Contact to the seed layer 3 on substrate 1 is made by contacts 11 arranged on the surface of the substrate. To help ensure good connection to the seed layer 3, typically, as illustrated in FIG. 1, the contacts 11 are arranged well into the seed layer 3.

Figure 2:
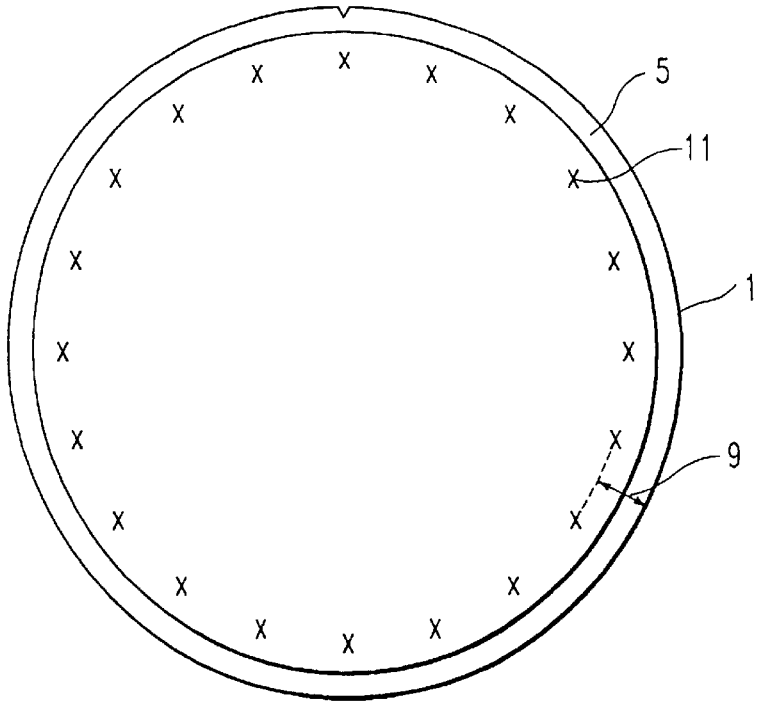
FIG. 2 PRIOR ART
FIG. 2 represents a top plan view of a semiconductor wafer illustrating the typical relative location of electrical contacts according to currently used electrodeposition apparatuses.

FIG. 2 illustrates an overhead of the substrate 1 illustrated in FIG. 1. As can be seen in FIG. 2, the contacts may be arranged about the substrate 1.

The number of contacts may vary depending upon the application. For example, the number of contacts may depend upon the size of the wafer. It may also depend upon the plating operation being carried out. For example, on a semiconductor substrate having a diameter of about 200 mm, if the electrodeposition operation is part of a C4 process, with a thick seed layer, as few as four contacts may be used. On the other hand, if the seed layer is thin, such as about 300 Å to about 500 Å, the number of contacts typically needs to be greater. A thin seed layer may require in excess of about 50 contacts. Also, for plating on substrates larger than about 200 mm in diameter, the number of contacts many need to exceed about 400.

Unlike typical known electrodeposition apparatuses, an apparatus according to the present invention does not require creating an exclusion zone around the perimeter of a substrate. Therefore, according to the present invention, clamps, shadow rings, or other devices utilized to prevent deposition in the vicinity in the perimeter of the substrate may be removed. Also, according to the present invention, a seed layer may be provided, such as by sputtering or being otherwise deposited, on a substrate all the way to the edge of the substrate. Rather than making contact on the surface of the wafer on the seed layer, the present invention provides for making contact on the sides, or minor surfaces, of a substrate.

Figure 3:
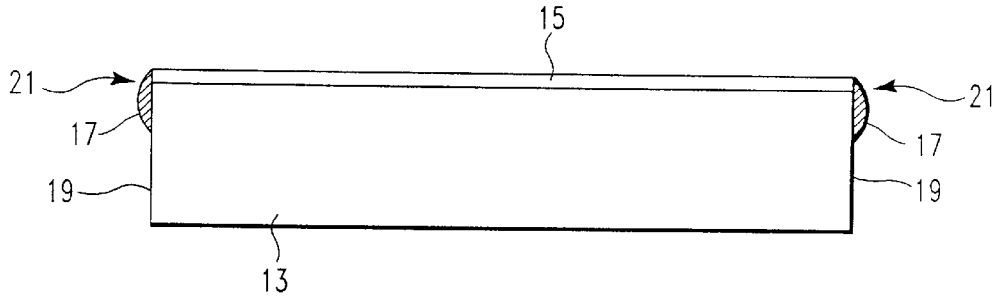
FIG. 3 represents a cross-sectional view of a semiconductor substrate being engaged by an embodiment of contacts according to the present invention.

FIG. 3 illustrates an example of a semiconductor substrate 13 having a seed layer 15 deposited on the entire upper surface thereof. Contact is made to the substrate in the seed layer through contacts 17 arranged on the side, or minor, surface 19 of the semiconductor substrate 13. The region of contact 21 between the contacts 17 and the substrate 13 and the seed layer 15 may be about the side surface(s) of the substrate.

As can be seen in FIG. 3, the contacts of the present invention laterally contact the substrate for providing electrical connection to the substrate. An electrodeposition apparatus according to the present invention can include any number of contacts to substrate. For example, a single contact could provide contact to the substrate. This single contact could be a single structure that engages the substrate at a plurality of points but still be part of a single contact structure. Such contacts could be considered to be continuous.

Alternatively, a single contact could continuously engage a substrate about its perimeter. According to the present invention, a plurality of contacts could be arranged around the substrate. The plurality of contacts could all be separate structures. Such contacts may considered to be discontinuous.

As can be seen in FIG. 3, contacts according to the present invention can provide electrical contact to a substrate without obscuring any of the upper surface of the substrate where material is to be electrodeposited. This is unlike the contact structures illustrated, for example, in FIGS. 1 and 2.

Figure 4A:
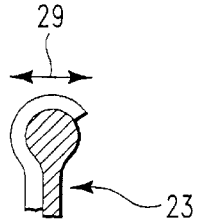
FIG. 4*a*, FIG. 4*b*, and FIG. 4*c* illustrate cross-sectional views of three embodiments of discontinuous contacts according to the present invention.
Figure 4B:
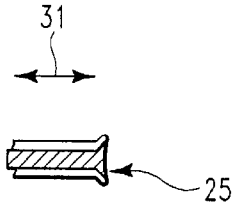
Figure 4C:
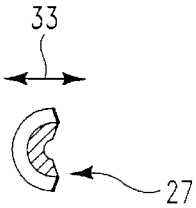

The shape of a contact according to the present invention may vary, depending upon the embodiment. FIGS. 4*a*, 4*b* and 4*c* illustrate various examples of embodiments of contacts according to the present invention. The contacts illustrated in FIGS. 4*a*, 4*b* and 4*c* typically are discontinuous contacts, wherein a plurality of contacts such as those illustrated in FIGS. 4*a*, 4*b*, and 4*c* are arranged about the side edge of a substrate.

The embodiment illustrated in FIG. 4*a* may make contact at a single point where the contact touches the seed layer or the seed layer in the substrate. On the other hand, the embodiment illustrated in FIG. 4*b* may make contact all along its length with the seed layer and the substrate. Furthermore, the embodiment illustrated in FIG. 4*c* may make contact with the seed layer and substrate at two points.

As illustrated by arrows 29, 31, and 33, the contacts 23, 25, and 27 may be moved laterally to engage and disengage from a seed layer and/or a substrate. To facilitate movement of the contacts, the present invention may include at least one spring for biasing the contact or contacts into contact, association, or engagement with the substrate/seed layer. The contact or contacts may be retractable against the force of the spring. Utilizing springs to urge the contacts into engagement with the seed layer and/or substrate may help to distribute force on the wafer to decrease wafer breakage. However, other means may be utilized to urge the contacts into engagement with the substrate and/or seed layer. If the present invention does not include a spring for biasing the contacts toward the substrate, it may include some sort of motor or other means for moving the contacts into and out of engagement with the substrate.

In addition to varying the number, arrangement, and shape of the contacts, the structure of the contacts may also vary. Along these lines, the composition of the contacts may vary. According to some embodiments, the contacts may be made of copper. According to other embodiments, the contacts may be made of stainless steel. The contact or contacts may also be made of other materials. Along these lines, the contact(s) may also include a mixture of copper and beryllium.

Additionally, portions of the contacts may be made of other materials. For example, the entire contact or just a portion of the contact that contacts the substrate and/or seed layer may be coated with another material. For example, the contact or portion of the contacts that engage the seed layer and/or substrate may have a coating of $\alpha$-Ta, nitrides of tantalum, gold, rhodium, and/or titanium nitride with Ti overlay, in other words, TiN/Ti. Examples of nitrides of tantalum include hexagonal-TaN and cubic-TaN.

Regardless of the composition of the contacts, they may be coated with another material. For example, the contacts may be coated with an elastomeric coating, such as VITON or polymers, such as PTFE or PVDF and their like. The polymer coating may be deposited on the contacts in order to prevent wasteful metal deposition in this region.

Whether a contact is made of copper, stainless steel, or any other electrically conductive material(s), such contacts could be coated with α-Ta, nitrides of tantalum, gold, rhodium, and/or titanium nitride with Ti overlay, an elastomeric or non-elastomeric polymer coating, and/or any other material.

Figure 7:
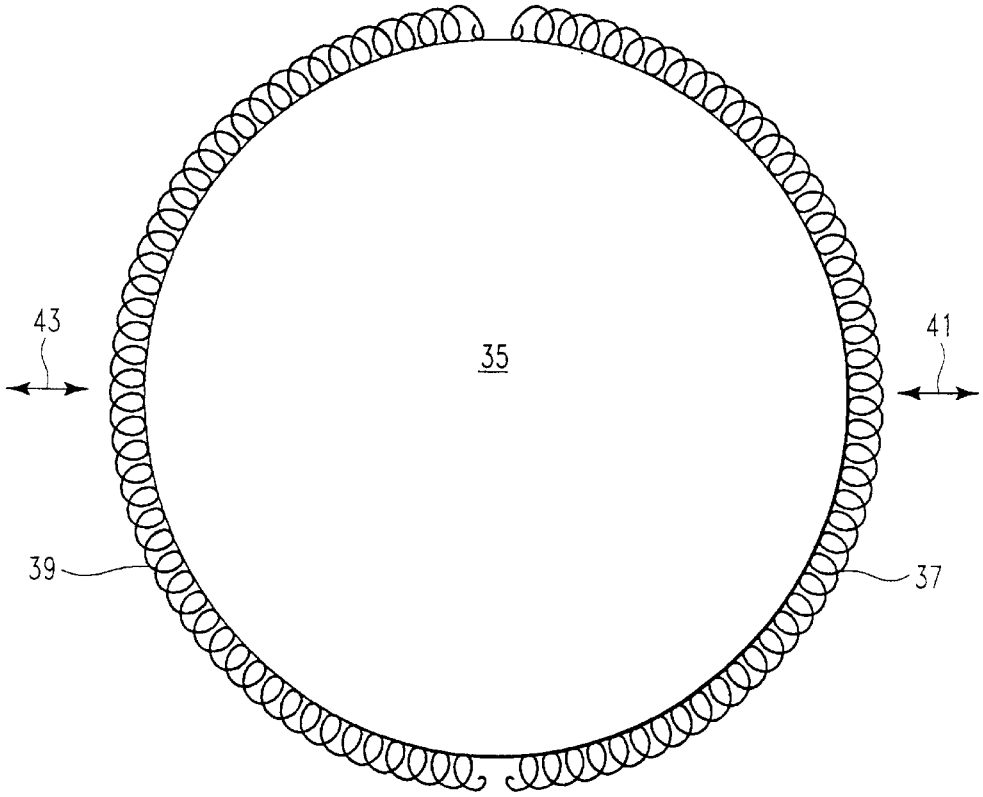
FIG. 7 represents a top plan view of a semiconductor substrate engaged by another embodiment of a contact according to the present invention.
Figure 8:
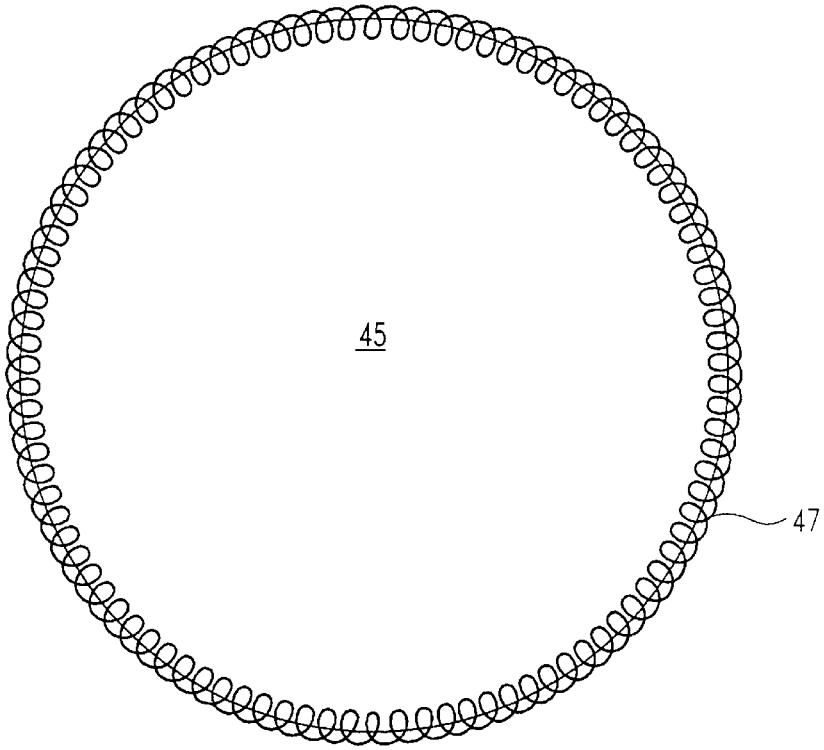
FIG. 8 represents a top plan view of another embodiment of a contact for an electrodeposition apparatus according to the present invention.

Contacts according to the present invention may have shapes other than those illustrated in FIGS. 4*a*, 4*b* and 4*c*. For example, the present invention may include contacts that are arranged in a spirally wound spring. FIGS. 7 and 8 illustrate two embodiments of such contacts.

If the contact or contacts include a spirally wound spring, the spring may extend substantially entirely about a semiconductor substrate. On the other hand, the spring may extend less than entirely around the substrate. For example, the present invention could include two spirally wound spring contacts that each extend about one half the distance around a substrate. On the other hand, the present invention can include more than two spirally wound springs that each extend about a portion of the outside of a substrate.

As can be seen in FIGS. 7 and 8, a spirally wound spring contact may make contact at a plurality of locations about a substrate. Such a spirally wound spring contact illustrates an example of a continuous contact according to the present invention. In other words, even though the contacts illustrated in FIGS. 7 and 8 may contact a plurality of locations around the substrate, the contacts may be part of a single structure.

The embodiment of the present invention illustrated in FIG. 7 includes two spirally wound springs 37 and 39 engaging a substrate 35. Springs 37 and 39 may be moved apart to arrange or load the substrate 35 between the spirally wound spring contacts prior to an electrodeposition processes. The spirally wound spring contacts may then be moved toward each other and toward the substrate to make electrical contact with the substrate and/or the seed layer. The springs may again be moved apart to unload the substrate from between the springs. Movement of the springs is indicated by arrows 41 and 43.

According to some embodiments, rather than making contact laterally with the substrate, a spirally wound spring may make contact with the seed layer and/or the surface of the substrate that the seed layer is deposited on. FIG. 8 illustrates such an embodiment of the present invention. As such, FIG. 8 illustrates a substrate 45 with a spirally wound spring contact 47 contacting the surface of the substrate that includes the seed layer.

Figure 9:
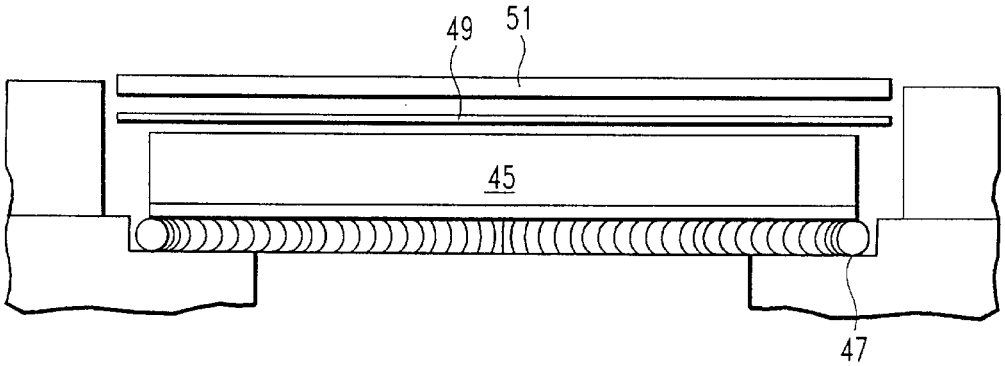
FIG. 9 represents a cross-sectional view of a portion of an embodiment of an electrodeposition apparatus according to the present invention including a contact such as that illustrated in FIG. 8.

FIG. 9 illustrates a cross-sectional view the substrate and spring 45 and 47 illustrated in FIG. 8. Accordingly, FIG. 9 illustrates the substrate 45 and spirally wound spring 47 making contact therewith.

The backside of the substrate, that side of the substrate that does not include the seed layer, may be sealed by seal 49. The seal could also be an O-ring type of seal. The seal 49, wafer, and spring may be clamped into position by clamp 51. The seal may be utilized to help prevent electrolytes from coming into contact with the backside of the substrate.

The spring contact, such as spring contacts 37 and 47 included in the embodiments illustrated in FIGS. 7 and 8 may have an outside diameter of about 1 mm to about 4 mm. As depicted in FIGS. 7 and 8, the spring is designed to wrap around the edge of the substrate.

Figure 5:
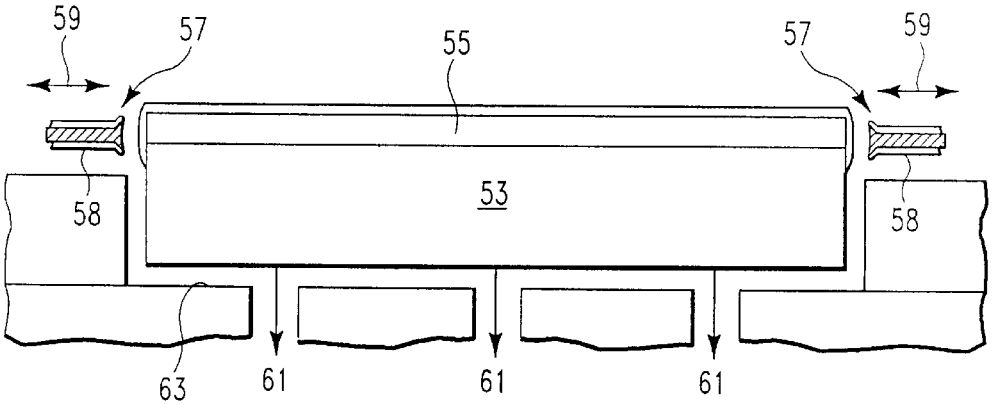
FIG. 5 illustrates a cross-sectional view of a semiconductor substrate and a portion of an embodiment of an electrodeposition apparatus according to the present invention on which the semiconductor substrate is arranged.

The present invention also includes a plating apparatus. A plating apparatus according to the present invention includes at least one contact such as those described above. FIG. 5 illustrates an embodiment of a plating apparatus according to the present invention including one embodiment of contacts according to the present invention. Along these lines, FIG. 5 illustrates a substrate 53 on which a seed layer 55 has been deposited.

The electrodeposition apparatus illustrated in FIG. 5 includes contacts 57. Contacts 57 include an polymer coating 58. The contacts may be moved into and out of engagement with substrate 53 as indicated by arrows 59.

The embodiment of the plating apparatus illustrated in FIG. 5 includes a vacuum 61 to maintain the substrate in place in the electrodeposition apparatus. The substrate may be supported by support surface 63 through which vacuum 61 may be applied to substrate 53. An electrodeposition apparatus according to the present invention may include other substrate supports for supporting and/or immobilizing the substrate.

The substrate support may also immobilize the substrate. Along these lines, the electrodeposition apparatus according to the present invention may include at least one immobilizer for immobilizing the substrate. For example, the at least one immobilizer could include at least one clamp for engaging a surface of the substrate. The at least one clamp could engage any portion of the surface of the substrate. For example, the at least one clamp could engage the surface of the substrate opposite the surface that includes the seed layer and/or on which the material is to be electrodeposited.

Figure 6:
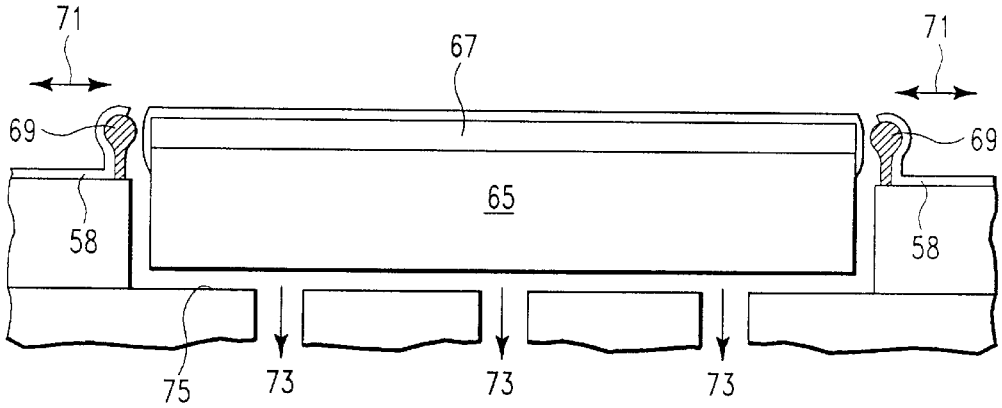
FIG. 6 represents a cross-sectional view of a semiconductor substrate arranged in another embodiment of an electrodeposition apparatus according to the present invention.

FIG. 6 illustrates another embodiment of an electrodeposition apparatus according to the present invention. A substrate 65 may be arranged on the electrodeposition apparatus. The substrate may be arranged on substrate support 75. A seed layer 67 has been deposited on substrate 65. The apparatus illustrated in FIG. 6 also includes vacuum 73 for urging the substrate 65 into engagement with substrate support 75.

Contacts 69 laterally engage the seed layer on the substrate. Contacts 69 may be moved into and out of engagement with the substrate as indicated by arrows 71. The contacts 57 illustrated in FIG. 5 are insulated. In this case, the contacts include an elastomeric coating 58 on the surfaces of the contacts that do not engage the substrate and/or the seed layer.

Figure 10:
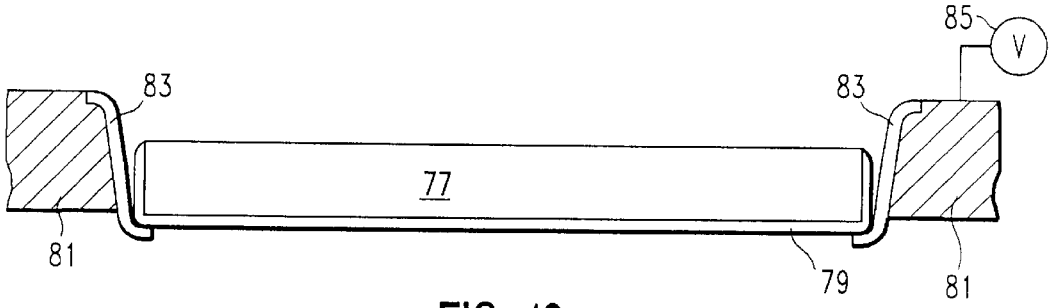
FIG. 10 represents a cross-sectional view of a portion of another embodiment of an electrodeposition apparatus according to the present invention illustrating a further embodiment of a contact according to the present invention.
Figure 11:
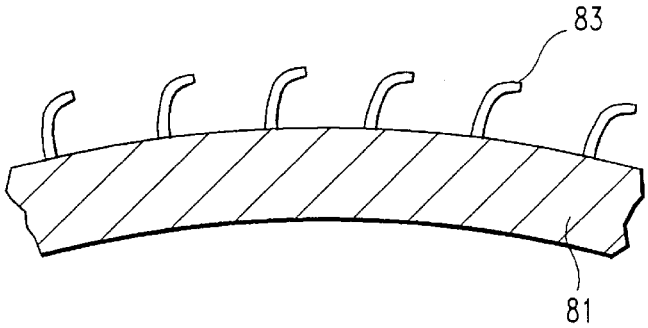
FIG. 11 represents a close-up perspective view of a portion of the embodiment of a contact illustrated in FIG. 10.
Figure 12:
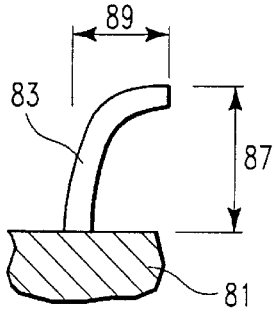
FIG. 12 represents a close-up cross-sectional view of an embodiment of a contact according to the present invention illustrated in FIGS. 10 and 11.

Contacts according to the present invention may also engage a corner of the substrate in addition to laterally engaging at least one side surface of a substrate. FIGS. 10, 11 and 12 illustrate an embodiment of the present invention that includes contacts that may engage a corner of a substrate. Along these lines, FIG. 10 illustrates a semiconductor substrate 77 with a seed layer 79 deposited thereon.

A ring 81 may be arranged about the substrate. A plurality of finger contacts 83 may be provided on ring 81 for making contact with the substrate 77/seed layer 79. The finger contacts may be attached to the ring. Alternatively, the ring and the contacts may be formed together as a single unit.

Finger contacts 83 may make peripheral and edge contact with substrate 77/seed layer 79. A voltage source 85 may be connected to the ring and finger contacts. Although not shown in all of the figures, a voltage source typically is connected to all of the contacts according to the present invention, regardless of their form/composition/shape etc. The contacts may be rendered cathodic relative to the anode.

FIG. 11 represents a perspective view of a portion of a ring 81 including finger contacts 83. FIG. 12 illustrates a close up cross-sectional view of an individual finger contact 83 according to the present invention. Finger contact 83 may have a height 87 of about 1.2 to about 10 times the thickness of the wafer. The side to side thickness of the wafer 89 may be about 1 mm. However, the finger contacts may be provided in any dimensions necessary to treat the substrate of any size.

The contacts typically are made of beryllium-copper spring, titanium, stainless steel or other suitable materials. The spacing between each contact 83 and its neighbor depends on the size of the substrate and the thickness of the seedlayer. For a seedlayer greater than about 2,000 Å, the spacing between the contacts may be larger than about 30 mm. On the other hand, for a thin seed layer, such as about 300 Å, the spacing can be smaller than about 10 mm.

The present invention also includes a method for depositing material on a surface of a substrate. The method includes laterally engaging the substrate on which material is to be deposited with at least one contact. The at least one contact laterally contacts the substrate and provides an electrical connection to the substrate without obscuring the surface of the substrate to be plated. A voltage source may be connected to the at least one contact. The contacts and plating apparatus may be provided substantially as described above. The at least one contact may be biased into contact with the substrate.

As stated above, the material being deposited may be deposited over the entire surface of the substrate that it is desired the material be deposited on. This is at least in part due to the fact that the contacts according to the present invention obscure the surface of the substrate on which material is being deposited. The at least one contact may be retracted. A corner of the substrate may also be engaged by the at least one contact. Also, the contact may be used to electroetch or electropolish metals on a substrate. In this case, the contacts are rendered anodic.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

I claim:

1. An electrodeposition apparatus for depositing material on a surface of a substrate, comprising:

at least one contact for laterally contacting the substrate and providing electrical connection to the substrate, wherein the at least one contact does not obscure the surface of the substrate to be plated, and wherein the at least one contact wraps around at least a portion of the substrate; and a voltage source connected to the at least one contact.

2. The apparatus according to claim 1, wherein the at least one contact moves laterally with respect to the substrate.

3. The apparatus according to claim 1, further comprising:

at least one spring for biasing the at least one contact into contact with the substrate.

4. The apparatus according to claim 1, wherein the at least one contact comprises copper.

5. The apparatus according to claim 4, wherein at least a portion of the copper that contacts the substrate is coated with at least one material selected from the group consisting of α-Ta, nitrides of tantalum, gold, rhodium, and titanium nitride with Ti overlay.

6. The apparatus according to claim 5, wherein the nitrides of tantalum include at least one of hexagonal-TaN and cubic-TaN.

7. The apparatus according to claim 5, wherein the at least one contact is coated with an elastomeric coating.

8. The apparatus according to claim 1, further comprising:

a plurality of contacts.

9. The apparatus according to claim 8, wherein the plurality of contacts are discontinuous.

10. The apparatus according to claim 9, wherein the plurality of contacts are continuous.

11. The apparatus according to claim 1, wherein the at least one contact permits the entire surface to be plated.

12. The apparatus according to claim 1, wherein the at least one contact is retractable.

13. The apparatus according to claim 1, wherein the at least one contact comprises stainless steel.

14. The apparatus according to claim 13, wherein at least a portion of the stainless steel that contacts the substrate is coated with at least one material selected from the group consisting of α-Ta, nitrides of tantalum, gold, rhodium, and titanium nitride with Ti overlay.

15. The apparatus according to claim 14, wherein the nitrides of tantalum include at least one of hexagonal-TaN and cubic-TaN.

16. The apparatus according to claim 1, wherein the at least one contact comprises copper and beryllium.

17. The apparatus according to claim 16, wherein at least a portion of the at least one contact that contacts the substrate is coated with at least one material selected from the group consisting of α-Ta and hexagonal-TaN.

18. The apparatus according to claim 1, wherein the at least one contact comprises at least one spirally-wound spring that laterally contacts the substrate at a plurality of locations.

19. The apparatus according to claim 18, wherein the at least one spirally-wound spring extends about one-half of the distance around the substrate.

20. The apparatus according to claim 1, wherein the at least one contact engages a corner of the substrate.

21. The apparatus according to claim 1, further comprising:

at least one substrate support for supporting the substrate.

22. The apparatus according to claim 21, wherein the at least one substrate support also immobilizes the substrate.

23. The apparatus according to claim 21, further comprising:

at least one vacuum source for immobilizing the substrate with respect to the at least one substrate support.

24. The apparatus according to claim 1, further comprising:

at least one immobilizer to immobilize the substrate.

25. The apparatus according to claim 24, wherein the at least one immobilizer comprises at least one clamp for engaging a surface of the substrate opposite the surface on which the material is to be deposited.

26. The apparatus according to claim 1, further comprising:

at least one seal for sealing a surface of the substrate opposite the surface on which the material is to be deposited.

27. An electrodeposition apparatus for depositing material on a surface of a substrate, comprising:

at least one contact for laterally contacting the substrate and providing electrical connection to the substrate, wherein the at least one contact does not obscure the surface of the substrate to be plated, wherein the at least one contact comprises at least one spirally-wound spring that laterally contacts the substrate at a plurality of locations; and a voltage source connected to the at least one contact.

28. The apparatus according to claim 27, wherein the at least one spirally-wound spring extends about one-half of the distance around the substrate.

29. The apparatus according to claim 27, wherein the at least one contact moves laterally with respect to the substrate.

30. The apparatus according to claim 27, wherein the at least one contact wraps around at least a portions of the substrate.

31. The apparatus according to claim 27, further comprising:

at least one spring for biasing the at least one contact into contact with the substrate.

32. The apparatus according to claim 27, wherein the at least one contact comprises copper.

33. The apparatus according to claim 32, wherein at least a portion of the copper that contacts the substrate is coated with at least one material selected from the group consisting of α-Ta, nitrides of tantalum, gold, rhodium, and titanium nitride with Ti overlay.

34. The apparatus according to claim 32, wherein the nitrides of tantalum include at least one of hexagonal-TaN and cubic-TaN.

35. The apparatus according to claim 32, wherein the at least one contact is coated with an elastomeric coating.

36. The apparatus according to claim 27, further comprising:

a plurality of contacts.

37. The apparatus according to claim 36, wherein the plurality of contacts are discontinuous.

38. The apparatus according to claim 36, wherein the plurality of contacts are continuous.

39. The apparatus according to claim 27, wherein the at least one contact permits the entire surface to be plated.

40. The apparatus according to claim 27, wherein the at least one contact is retractable.

41. The apparatus according to claim 27, wherein the at least one contact comprises stainless steel.

42. The apparatus according to claim 41, wherein at least a portion of the stainless steel that contacts the substrate is coated with at least one material selected from the group consisting of α-Ta, nitrides of tantalum, gold, rhodium, and titanium nitride with Ti overlay.

43. The apparatus according to claim 42, wherein the nitrides of tantalum include at least one of hexagonal-TaN and cubic-TaN.

44. The apparatus according to claim 27, wherein the at least one contact comprises copper and beryllium.

45. The apparatus according to claim 44, wherein at least a portion of the at least one contact that contacts the substrate is coated with at least one material selected from the group consisting of α-Ta and hexagonal-TaN.

46. The apparatus according to claim 27, wherein the at least one contact engages a corner of the substrate.

47. The apparatus according to claim 27, further comprising:

at least one substrate support for supporting the substrate.

48. The apparatus according to claim 47, wherein the at least one substrate support also immobilizes the substrate.

49. The apparatus according to claim 47, further comprising:

at least one vacuum source for immobilizing the substrate with respect to the at least one substrate support.

50. The apparatus according to claim 27, further comprising:

at least one immobilizer to immobilize the substrate.

51. The apparatus according to claim 50, wherein the at least one immobilizer comprises at least one clamp for engaging a surface of the substrate opposite the surface on which the material is to be deposited.

52. The apparatus according to claim 27, further comprising:

at least one seal for sealing a surface of the substrate opposite the surface on which the material is to be deposited.

53. A method for depositing material on a surface of a substrate, the method comprising:

laterally engaging a substrate on which material is to be deposited with at least one contact for laterally contacting the substrate and providing electrical connection to the substrate without obscuring the surface of the substrate to be plated, wherein the at least one contact is provided comprised of at least one spirally-wound spring that laterally contacts the substrate at a plurality of locations; and connecting a voltage source to the at least one contact.

54. The method according to claim 53, wherein the at least one spirally-wound spring is provided extending about one-half of the distance around the substrate.

55. The method according to claim 53, further comprising:

providing electrodeposition apparatus for depositing material on the surface of the substrate, wherein the electrodeposition apparatus comprises the at least one contact for laterally contacting the substrate and providing electrical connection to the substrate and the voltage source.

56. The method according to claim 53, further comprising:

biasing the at least one contact into contact with the substrate.

57. The method according to claim 55, further comprising:

providing the electrodeposition apparatus with at least one spring for biasing the at least one contact into association with the substrate.

58. The method according to claim 55, wherein the at least one contact is provided comprised of copper.

59. The method according to claim 58, further comprising:

coating at least a portion of the copper that contacts the substrate with at least one material selected from the group consisting of α-Ta, nitrides of tantalum, gold, rhodium, and titanium nitride with Ti overlay.

60. The method according to claim 59, wherein the nitrides of tantalum include at least one of hexagonal-TaN and cubic-TaN.

61. The method according to claim 58, further comprising:

coating at least a portion of the at least one contact with an elastomeric coating.

62. The method according to claim 57, further comprising:

providing the electrodeposition apparatus with a plurality of contacts.

63. The method according to claim 55, further comprising:

providing the electrodeposition apparatus with a plurality of discontinuous contacts.

64. The method according to claim 55, further comprising:

providing the electrodeposition apparatus with a plurality of continuous contacts.

65. The method according to claim 53, further comprising:

depositing the material over the entire surface of the substrate.

66. The method according to claim 53, further comprising:

retracting the at least one contact out of contact with the substrate, wherein the at least one contact is retractable.

67. The method according to claim 53, wherein the at least one contact is provided comprised of stainless steel.

68. The method according to claim 67, further comprising:

coating at least a portion of the stainless steel that contacts the substrate with at least one material selected from the group consisting of α-Ta and hexagonal-TaN.

69. The method according to claim 53, wherein the at least one contact is provided comprised of copper and beryllium.

70. The method according to claim 69, further comprising:

coating at least a portion of the at least one contact that contacts the substrate with at least one material selected from the group consisting of α-Ta and hexagonal-TaN.

71. The method according to claim 53, further comprising:

engaging a corner of the substrate with the at least one contact.

72. The method according to claim 53, further comprising:

providing the electrodeposition apparatus with at least one substrate support for supporting the substrate.

73. The method according to claim 72, further comprising:

immobilizing the substrate with the at least one substrate support.

74. The method according to claim 72, further comprising:

providing the electrodeposition apparatus with at least one vacuum source for immobilizing the substrate with respect to the at least one substrate support.

75. The method according to claim 53, further comprising:

providing the electrodeposition apparatus with at least one immobilizer to immobilize the substrate; and immobilizing the substrate.

76. The method according to claim 75, further comprising:

providing the at least one immobilizer with at least one clamp for engaging a surface of the substrate opposite the surface on which the material is to be deposited.

77. The method according to claim 53, further comprising:

providing the electrodeposition apparatus with at least one seal for sealing a surface of the substrate opposite the surface on which the material is to be deposited; and sealing the surface of the substrate opposite the surface on which the material is to be deposited.

78. An electrodeposition apparatus for depositing material on a surface of a substrate, comprising:

at least one contact for laterally contacting the substrate and providing electrical connection to the substrate, wherein the at least one contact does not obscure the surface of the substrate to be plated, wherein the at least one contact comprises copper, wherein at least a portion of the copper that contacts the substrate is coated with at least one material selected from the group consisting of α-Ta, nitrides of tantalum, gold, rhodium, and titanium nitride with Ti overlay; and a voltage source connected to the at least one contact.

79. The apparatus according to claim 78, wherein the nitrides of tantalum include at least one of hexagonal-TaN and cubic-TaN.

80. An electrodeposition apparatus for depositing material on a surface of a substrate, comprising:

at least one contact for laterally contacting the substrate and providing electrical connection to the substrate, wherein the at least one contact does not obscure the surface of the substrate to be plated, wherein the at least one contact comprises stainless steel, wherein at least a portion of the stainless steel that contacts the substrate is coated with at least one material selected from the group consisting of α-Ta, nitrides of tantalum, gold, rhodium, and titanium nitride with Ti overlay; and a voltage source connected to the at least one contact.

81. The apparatus according to claim 80, wherein the nitrides of tantalum include at least one of hexagonal-TaN and cubic-TaN.

82. An electrodeposition apparatus for depositing material on a surface of a substrate, comprising:

at least one contact for laterally contacting the substrate and providing electrical connection to the substrate, wherein the at least one contact does not obscure the surface of the substrate to be plated, wherein the at least one contact comprises copper and beryllium, wherein at least a portion of the at least one contact that contacts the substrate is coated with at least one material selected from the group consisting of α-Ta and hexagonal-TaN; and a voltage source connected to the at least one contact.

83. A method for depositing material on a surface of a substrate, the method comprising:

providing, electrodeposition apparatus for depositing material on the surface of the substrate, wherein the electrodeposition apparatus comprises at least one contact for laterally contacting the substrate and providing electrical connection to the substrate and the voltage source without obscuring the surface of the substrate to be plated, wherein the at least one contact is provided comprised of copper;

coating at least a portion of the copper that contacts the substrate with at least one material selected from the group consisting of α-Ta, nitrides of tantalum, gold, rhodium, and titanium nitride with Ti overlay;

laterally engaging a substrate on which material is to be deposited with the at least one contact; and connecting a voltage source to the at least one contact.

84. The method according to claim 83, wherein the nitrides of tantalum include at least one of hexagonal-TaN and cubic-TaN.

85. A method for depositing material on a surface of a substrate, the method comprising:

providing an electrodeposition apparatus for depositing material on the surface of the substrate, wherein the electrodeposition apparatus comprises at least one contact for laterally contacting the substrate and providing electrical connection to the substrate and the voltage source without obscuring the surface of the substrate to be plated, wherein the at least one contact is provided comprised of copper;

coating at least a portion of the at least one contact with an elastomeric coating;

laterally engaging a substrate on which material is to be deposited with the at least one contact; and connecting a voltage source to the at least one contact.

86. A method for depositing material on a surface of a substrate, the method comprising:

laterally engaging a substrate on which material is to be deposited with at least one contact for laterally contacting the substrate and providing electrical connection to the substrate without obscuring the surface of the substrate to be plated, wherein the at least one contact is provided comprised of stainless steel and at least a portion of the stainless steel that contacts the substrate is coated with at least one material selected from the group consisting of α-Ta and hexagonal-TaN; and connecting a voltage source to the at least one contact.

87. A method for depositing material on a surface of a substrate, the method comprising:

laterally engaging a substrate on which material is to be deposited with at least one contact for laterally contacting the substrate and providing electrical connection to the substrate without obscuring the surface of the substrate to be plated, wherein the at least one contact is provided comprised of copper and beryllium and at least a portion of the at least one contact that contacts the substrate is coated with at least one material selected from the group consisting of α-Ta and hexagonal-TaN; and connecting a voltage source to the at least one contact.

* * * * *

UNITED STATES PATENT AND TRADEMARK OFFICE

CERTIFICATE OF CORRECTION

PATENT NO. : 6,217,734 B1
DATED : April 17, 2001
INVENTOR(S) : Cyprian E. Uzoh

It is certified that error appears in the above-identified patent and that said Letters Patent is hereby corrected as shown below:

Column 5,
Line 53, after "view" insert -- of --.

Column 8,
Line 20, change "9" to -- 8 --.

Column 9,
Line 23, change "portions" to -- portion --.

Signed and Sealed this

Sixteenth Day of April, 2002

*Attest:*

*Attesting Officer*

JAMES E. ROGAN
*Director of the United States Patent and Trademark Office*